US005217130A

United States Patent [19]

Weinstein

[11] Patent Number: 5,217,130

[45] Date of Patent: Jun. 8, 1993

[54] CHILD RESISTANT CAP WITH BIASED KEYWAY

[75] Inventor: Jack Weinstein, Manchester Township, Ocean County, N.J.

[73] Assignee: Primary Delivery Systems, Inc., Easton, Pa.

[21] Appl. No.: 862,719

[22] Filed: Apr. 3, 1992

Related U.S. Application Data

[63] Continuation-in-part of Ser. No. 660,025, Feb. 25, 1991.

[30] Foreign Application Priority Data

Nov. 20, 1991 [CA] Canada ..... 2055906
Jan. 9, 1992 [GB] United Kingdom ..... 9200395

[51] Int. Cl.[5] ..... B65D 55/02

[52] U.S. Cl. ..... 215/220; 215/206; 215/208; 215/219

[58] Field of Search ..... 215/204, 206, 208, 218, 215/219, 220, 222, 330, 332, 334

[56] References Cited

U.S. PATENT DOCUMENTS

| | | | |
|---|---|---|---|
| 2,381,207 | 8/1945 | Coleman | 215/206 |
| 2,597,307 | 5/1952 | Elkind | 215/220 |
| 2,908,413 | 10/1959 | O'Donnell . | |
| 2,964,207 | 12/1960 | Towns | 215/220 |
| 3,311,247 | 3/1967 | Rigor | 215/206 |
| 3,394,829 | 7/1968 | Peterson | 215/220 |
| 3,447,709 | 6/1969 | Marasco . | |
| 3,468,444 | 9/1969 | Martin, Jr. . | |
| 3,656,645 | 4/1972 | Fontenelli . | |
| 3,679,085 | 7/1972 | Gach | 215/220 |
| 3,820,676 | 6/1974 | Mucsi | 215/220 |
| 3,822,805 | 7/1974 | Marchant | 215/219 |
| 3,870,182 | 3/1975 | Georgi | 215/220 |
| 3,896,335 | 7/1975 | Bogert | 215/219 |
| 3,918,602 | 11/1975 | McIntosh | 215/219 |
| 4,387,821 | 6/1983 | Geiger | 215/330 |
| 4,641,759 | 2/1987 | Kelley | 215/220 |
| 4,770,308 | 9/1988 | Lynn | 215/330 |
| 4,779,747 | 10/1988 | Morel . | |
| 4,998,632 | 3/1991 | Morris, Sr. | 215/201 |
| 5,092,477 | 3/1992 | Johnson, Jr. et al. | 215/230 |
| 5,148,931 | 9/1992 | Minh | 215/220 |

*Primary Examiner*—Allan N. Shoap
*Assistant Examiner*—Vanessa Caretto
*Attorney, Agent, or Firm*—Kenneth P. Glynn

[57] ABSTRACT

The present invention involves a child resistant closure for containers with threaded necks. It involves a cylindrical inner and outer cap which engage with one another by ratchets to close the closure. These ratchets do not engage when an attempt is made to open the closure. The inner cap has threads on its inside and is adapted to non-removably receive the outer cap in that the outer cap is rotatably engaged therewith. The outer cap is non-removably but rotatably mounted on and engaged with the inner cap. At least two biased keyway slots are used and each may be located either on the outside of the inner cap or the inside of the outer cap. There are at least two biased keyway protrusions, one corresponding to each slot, and each protrusion extends toward its corresponding keyway slot. Each is located on which ever of the inner cap and outer cap does not contain the corresponding slot. There are indexes on each of the caps and when they are aligned, the keyway protrusions ad their corresponding keyway slots will be aligned. The user will align the indexes or indicia and then lift up so that the protrusions fit into their keyway slots. In this manner, the outer cap engages the inner cap so that they are simultaneously rotated for opening. Upon closure ,the protrusion will be pushed or dropped out of the slot and the ratchets will engage for proper closure.

11 Claims, 4 Drawing Sheets

CHILD RESISTANT CAP WITH BIASED KEYWAY

REFERENCE TO RELATED APPLICATION

This application is a continuation-in-part of copending U.S. patent application Ser. No. 07/660,025 filed on Feb. 25, 1991 and entitled "Child Resistant Cap with Keyway", by the inventor herein.

BACKGROUND OF THE INVENTION

1. Field of the Invention

The present invention is directed to a child resistant closure for containers having threaded necks. More specifically, it is directed to a child resistant closure which involves an inner and an outer cap which easily close by way of ratchets but require certain movements to engage the inner cap and outer cap to effect opening of the closure.

2. Prior Art Statement

There are truly many hundreds of patents covering variations on child proof closures. Many of these rely upon the use of inner caps and outer caps coupled with ratchet engagement and disengagement for closing and more difficult opening. Indeed, the child resistant cap which is currently most popular involves the use of an inner cap and an outer cap with ratchets that easily engage for closing but require substantial downward force for opening. While this is advantageous in preventing small children from opening medicine containers, it creates serious difficulties for the aged, for people with grip or strength difficulties such as people with arthritis, as well as other types of manual dexterity problems. The present invention is directed toward overcoming the strength requirements while still maintaining a child resistant feature. Significantly, the present invention achieves this by way of a cap which requires only two molded parts in its preferred embodiments.

U.S. Pat. No. 2,908,413 issued to T. J. O'Donnell on Oct. 13, 1959 describes a safety cap which involves an outer cap and an inner ring whereby the bumps or protrusions on the inner cap must be aligned with a slot or opening in a ring on the neck of a threaded bottle in order for the outer cap itself to be effectively unscrewed. This is similar to the present invention in that it requires an alignment of protrusions and subsequent lifting and turning. However, O'Donnell requires manual resetting and realignment in order to properly secure the cap and, in those cases where the protrusions are not aligned, the outer cap may be rotated and cause stresses to the ring thereby damaging the cap. Importantly, O'Donnell is completely lacking in any automatic reset of the safety feature of that device.

U.S. Pat. No. 3,468,444 issued to J. Martin, Jr. on Sep. 23, 1969 is also directed to an inner cap and an outer cap. In this particular invention, the outer cap and inner cap must be properly aligned by setting indexes to one another and then the outer cap must be squeezed so that protrusions fit into recesses in the inner cap so that the inner cap may be engaged for removal. Unfortunately, this invention requires squeezing for opening and closing and does not contribute to overcoming the problem that arthritics and other people who have diminished dexterity and strength would experience. Further, the Martin invention requires alignment and squeezing for retightening the inner cap onto the container.

U.S. Pat. No. 3,447,709 issued to V. Marasco on Jun. 3, 1969 describes a locking cap for bottles which involves the traversal of a particular track coupled with a release type lever or pin. This release handle involves a complicated device and requires a single digit use to effect opening. Further, the device involves complex manufacturing techniques which would be eliminated by the present invention.

U.S. Pat. No. 3,656,645 issued to John Fontenelli on Apr. 18, 1972 describes a two piece safety closure cap which involves a top cap and a ring with engagement of the lip of a container whereby tracks are utilized and proper alignment is necessary in order to open the cap. However, this does not involve the type of arrangement utilized in the present invention where protrusions must be properly aligned and then moved into a keyway slot in order to enable an inner cap and outer cap to rotate together in an opening fashion.

U.S. Pat. No. 4,779,747 issued on Oct. 25, 1988 to Simone Morel involves a container with a three piece safety closure which requires alignments of the three parts so that the top cap may be rotatably removed from the neck of the container. While this invention involves some alignment, it does not involve a keyway slot and requires three components and alignment of these three components in order to effectuate opening of the closure.

Thus, notwithstanding the tremendous quantity of ideas and patents covering safety closures, it is believed that none of the prior art teaches or renders obvious the present invention which involves the use of a keyway system for proper engagement of an inner cap and a outer cap to create a child resistant closure which will be easily operated by users with low strength or weak manual capabilities.

SUMMARY OF THE INVENTION

The present invention involves a child resistant closure for containers with threaded necks. It involves an inner cap and an outer cap which engage with one another by ratchets in order to close but these ratchets do not engage when an attempt is made to open the closure. The inner cap and the outer cap are generally cylindrical and have sides and a top, although one or the other may have an open top. The inner cap has threads on its inside and is adapted to non-removably receive the outer cap so that the outer cap is rotatably engaged therewith. The outer cap is non-removably but rotatably mounted on and engaged with the inner cap. At least two biased keyway slots are used and each may be located either on the outside of the inner cap or the inside of the outer cap. There are at least two biased keyway protrusions, one corresponding to each slot, and each protrusion extends toward its corresponding keyway slot. Each is located on whichever of the inner cap and outer cap does not contain the corresponding slot. By "biased" is meant that only one position permits a match of slots and protrusions. There are indexes on each of the caps and when they are aligned, the keyway protrusions and their corresponding keyway slots will be aligned. The user will align the indexes or indicia and then lift up so that the protrusions fit into their keyway slots. In this manner, the outer cap engages the inner cap so that they are simultaneously rotated for opening. Upon closure, the protrusion will be pushed or dropped out of the slot and the ratchets will engage for proper closure.

BRIEF DESCRIPTION OF THE DRAWINGS

The present invention will be more fully understood and appreciated when the present specification is taken in conjunction with the drawings appended hereto, wherein.

DETAILED DESCRIPTION OF THE PRESENT INVENTION

Figure 1:
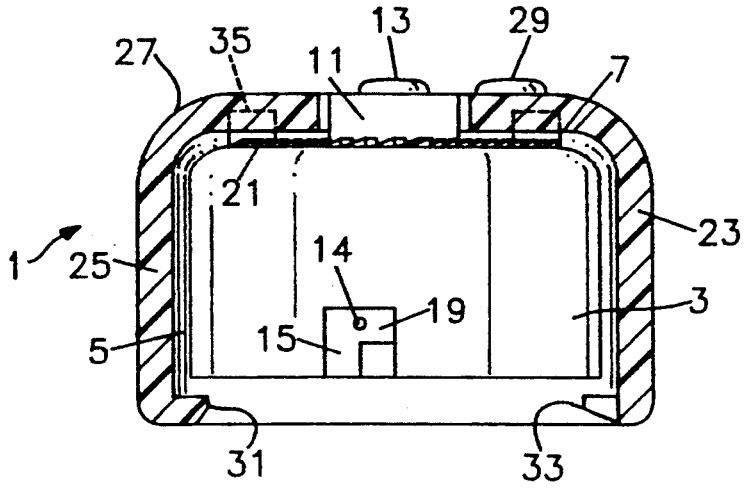
FIG. 1 shows a side view of a present invention closure showing the full inner cap and a cut side view of the outer cap.

The present invention involves a child resistant closure which is believed to be superior to the present commercially available closures which rely upon inner caps and outer caps with ratcheting engagement. As mentioned in the prior art statement, the conventional double cap requires substantial strength in order to be opened in that the outer cap must be pushed downward and twisted simultaneously to properly engage the inner cap for opening such a closure. It is this very feature which renders the cap of the prior art child resistant yet imposes serious problems for the aged, arthritics and other people with dexterity problems. Likewise, it is this deficiency which motivated the development of the present invention herein.

The present invention child resistant closure is for containers with a threaded neck. It includes an inner cap of a generally cylindrical configuration with sides and a top with the threads on its inside. These threads are adapted so as to be screwed downwardly onto and, when reversed, upwardly off a container having a threaded neck. Further, the inner cap is adapted to non-removably receive an outer cap which will then be rotatably engaged thereon. The outer cap of the present invention child resistant closure is likewise generally cylindrical in configuration with sides and a top, although either the inner cap or the outer cap may have an open top. The outer cap is non-removably mounted on the inner cap and is rotatable thereon. There are at least two keyway slots, each of which may be located either on the inside of the outer cap or on the outside of the inner cap. There may be two keyway slots or more, as may be desired. In addition, the other of the inner and outer cap, i.e. the one that does not contain the keyway slot, will contain at least one corresponding keyway protrusion and there will be typically as many protrusions as there are slots. These protrusions extend toward the keyway slots and the protrusions and slots are biased, i.e. designed to "fit" in only one rotational position. Further, these biased protrusions (or keys) may be engaged with the keyway slots only when two indicia, one located on the inner and one on the outer cap, are aligned with one another. Otherwise, when they are not aligned, the protrusion is free to rotate horizontally, but can not be lifted up in any manner to engage with the inner cap. In other words, only when there is a proper alignment will the keyway slots and keyway protrusions be in vertical alignment and only then, upon lifting will the outer cap and the inner cap cause the keyway slots and keyway protrusions to be engaged so that both the inner cap and outer cap may be rotated together for removal of the present invention closure. In order to effectuate closing of the present invention child resistant closure, ratchet ramps are utilized which operate to engage upon closing but slip past one another upon opening. These ratchets have sets and counterpart sets on either the tops or bottoms or on horizontal rigids or planes or otherwise on both the outer and inner caps. These "ratchet ramps" are not a novel feature of the invention and it should be understood that any equivalent could be used without exceeding the scope of the present invention. In other words, "ratchet ramps" is defined as any type of embossment or protrusion which are located in part on the inner cap and in part on the outer cap which engage in one direction and fail to engage in the opposite direction, i.e. in this case engage upon closing and do not readily engage upon opening.

The keyway protrusions are located in a plane different from keyway slots relative to the tops of the inner and outer caps. In other words, one is higher or lower than the other. Additionally, the keyway slots and keyway protrusions are typically freely rotatable relative to one another in a circular manner in a horizontal plane without being engaged.

In some preferred embodiments, to prevent accidental engagement of protrusions and slots by children while in random rotation (counterclockwise) with an upward pull of the outer cap, a small detent may be located at the proximal edge of the keyway aligning slot to cause the outer cap protrusion to skip over the keyway aligning slot. If outer cap is rotated counter-clockwise with a downward bias, the outer cap protrusions will not contact the skip detent and be freely rotatable.

As mentioned, it is only when the indicia are aligned and the outer cap is lifted up that the biased keyway slots and biased keyway protrusions become engaged. Further, upon closure, the protrusions may ride within the keyway slots during closure but will typically either drop down or be pushed down so as to be freely rotational relative to one another once again, and it will be the ratchet ramps which will assist in assuring simple closure. In other words, the ratchet ramp feature will enable the user to always be able to readily close the present invention closure.

In some embodiments, the protrusions may be located closer to the bottom than the top of the cap on which it is located, or vice versa. In other embodiments, the protrusions may be located on the outer cap at a position below the bottom of the inner cap so as to be freely rotatable below the bottom of the inner cap. This will eliminate the need for an extra track or indentation for the rotation of the protrusions and will cut down on the complexity of the mold of the manufacturer as well as reduce the amount of plastic or other material needed for the inner cap.

In the present invention, the bias of the protrusions and slots may be achieved by the locations of the slots and protrusions around the caps may be offset, i.e., non-symmetrical, or each of the protrusion and slot sets may have different configurations. In one preferred embodiment, two protrusions and keyway slots are utilized and they may be identical in configuration, yet offset from one another, e.g. 190 degrees apart, or any other asymmetric angle (i.e. other than 180 degrees apart) so that the protrusions and slots fit in only one position. If three protrusions are used and are identical they cannot all be 120 degrees apart. As an alternative, when multiple protrusions and slots are used, whether they are symmetrically or asymmetrically arranged, they may have differing topography, i.e. the slots may be of different widths and the protrusions of corresponding widths, that only one particular protrusion will cooperate with only one slot. Alternatively, they may have different shapes, etc., top cross-section of one protrusion and slot may be rectangular and another set be triangular. Or, as set forth in the above-cited parent case, they may be of different depths (lengths). Using differing topography or asymmetric arrangements will reduce the likelihood of accidental engagement in the case where there are multiple protrusions.

In yet another embodiment, a small bump or stop may be included in the keyway slots so as to again discourage accidental engagement of the protrusions with the keyway slots.

Federal Consumer Product Safety Regulations for continuous thread caps ("CT" caps) are, in part, directed to a serious problem with CT caps namely, in general, one cannot discern visibly whether or not a reclosed CT cap has been closed sufficiently to activate the child-resistant mechanism. The Federal Register, Vol. 55, No. 194 (Oct. 5, 1990) states that some types of child resistant packaging do not lend themselves to a visual or mechanical determination of whether the package has been returned to the child-resistant state after normal closing by adults. To address this problem, the Commissioner's staff devised a procedure (16 CFR 1700 et seq.). In preferred embodiments of the present invention, the outer cap drops down when properly closed and this lower position is a clear visual indication of proper closure, negating the need for such concerns. Optionally, an indicator could be exposed when the outer cap is up and covered when it is down ("up", meaning protrusions in the top legs of the keyways, and "down" meaning in the horizontal track).

To even further enhance these advantages of the present invention, the bump or stop mentioned above, as a riding feature may be included with the aforementioned drop down feature. Thus, in yet another embodiment, the keyway slots may be uniquely designed to have a riding feature and may slant away from itself in the direction of opening so as to discourage accidental engagement.

The riding feature may be a bump, stop or dot of material protruding in the keyway or a ridge along an edge of the keyway so that the protrusion slides over and past it with a slight amount of force. This feature will effect a minimal closing torque of the inner cap in a reclosure, so that when the lugs are free to drop in the keyway to the horizontal track the system will be in a child resistant position even if no further torque is applied by the user by means of the top ratchets. If located at the beginning of the top leg of a keyway, it could prevent accidental back-up of the protrusion and enhance automatic dropping of the outer cap (protrusions drop down the keyways to the horizontal track—i.e. proper closure). In yet another embodiment, a male/-female plug and recess could be used whereby a wide protrusion would be at the top of an upward keyway leg and to one side of the plug. When moved into the top leg of the key, it might not enter completely, and the protrusion may or may not include a recess to correspond to the location of the plug when the protrusion is in that position.

Referring now to FIG. 1, there is shown a view of present invention child resistant closure 1 which includes a side cut view of outer cap 23 and a full side view of inner cap 3. In this embodiment, inner cap 3 includes inner cap sides 5 and top 7. The inner cap 3 has a circular extension 11 which extends upwardly and has a generally circular pattern. On top of circular extension 11 is index or indicia 13 for proper alignment of inner cap 3 with outer cap 23. Also located on inner cap 3 is keyway slot 15 which includes a slot leg in the horizontal direction, as shown, as top leg 19. Shown in dotted line fashion and located on top 7 of inner cap 3 are ratchet ramps 21 which correspond to a set of ratchet ramps 35 located on top 27 of outer cap 23. These generally engage in the closing direction and are ramped so as to slip over one another in the opening direction. Outer cap 23 has sides 25 and top 27 as well as indicia 29 for alignment, as mentioned. Keyway protrusions 31 and 33 are shown at the bottom of outer cap 23 and literally hang below inner cap 3. They perform both as protrusions for eventual engagement with corresponding keyway slots, such as keyway slot 15 and also act so as to keep outer cap 23 on inner cap 3 on a rotatable but non-removable mounting. These keyway protrusions 31 and 33 are identical in cross-section but are biased by being asymmetrically positioned with respect to one another. Optional bump 14 is strategically located just off the top of the vertical leg of slot 15 and aids in the automatic return dropping of the outer cap 23 upon closure. Also aids in reclosing inner cap to minimum torque to assure child resistant feature. Once past bump 14, outer cap drops indicating child resistant feature of closure.

Figure 2:
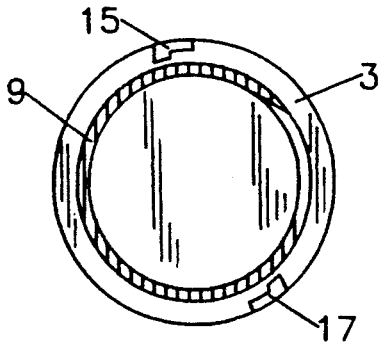
FIG. 2 shows a bottom view of the inner cap shown in FIG. 1.

Referring now to FIG. 2, there is a bottom view of inner cap 3 shown. It includes threads 9 and keyway slots 15 and 17. Threads 9 are located on the inside of inner cap 3 for screwing and unscrewing in conjunction with a threaded neck of a container or bottle such as a medicine bottle. Not shown in the bottom view in FIG. 2 would be the aforementioned ratchet ramps such as ratchet ramps 21 shown in FIG. 1. Note that these keyway slots 15 and 17 are not 180 degrees apart but are about 160 degrees apart. This asymmetry allows for operation in only one position, i.e. when protrusion 31 is aligned with slot 15 (and then and only then will protrusion 33 align with slot 17.

Figure 3:
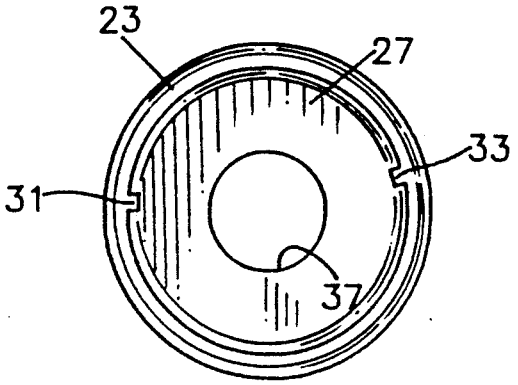
FIG. 3 shows a bottom view of the outer cap which is shown in its side cut view in FIG. 1.

FIG. 3 shows a bottom full view of outer cap 23 with corresponding biased keyway protrusions 31 and 33 located on the inside wall of outer cap 23. Top 27 includes an orifice 37 which fits over circular extension 11 of inner cap 3 which is shown in FIG. 1.

As can be seen, taking FIGS. 1, 2, and 3 together, the present invention closure 1 can be screwed onto a container by ratchet engagement and, if a child tries to unscrew it, the outer cap 23 will merely rotate about inner cap 3. However, in the event that a user first aligns indicia 13 and 29 and then lifts up and rotates in an opening direction, protrusions 31 and 33 will engage with the vertical and horizontal portions of keyway slots 15 and 17 so as to effect proper opening. When the device is screwed back on, outer cap 23 will drop down with the protrusions 31 and 33 dropping out of keyway slots 15 and 17, after overcoming torque bump 14 in keyway slot 19, enabling the ratchet ramps 21 and 35 to engage for closing. If there is a pulling or upward movement of the outer cap relative to the inner cap during closing, then protrusions 31 and 33 will cooperate with keyway slot 15 to close the present invention closure 1 onto a container or bottle, but this is most unlikely and the ratchets will be generally the primary means of easy closure.

Figure 4:
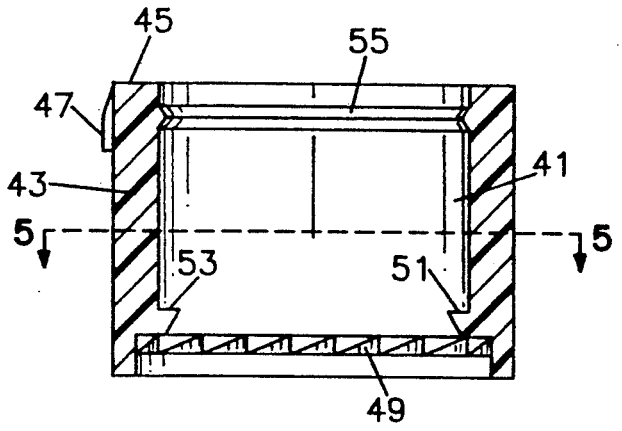
FIG. 4 shows a side view cut view of an outer cap of an alternative preferred embodiment closure of the present invention.
Figure 5:
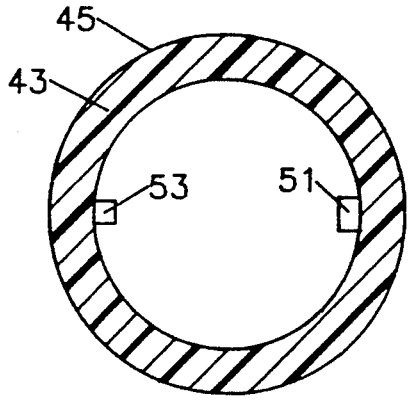
FIG. 5 shows a top cut view of the FIG. 4 outer cap, showing protrusions of different widths.
Figure 6:
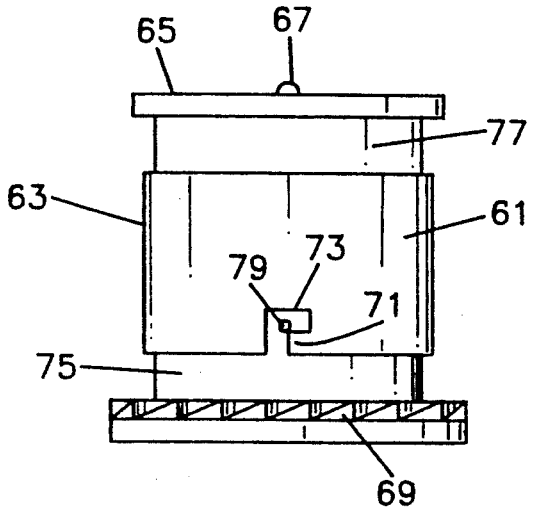
FIG. 6 shows a side view of an inner cap which may be used in conjunction with the outer cap shown in FIGS. 4 and 5 to create a present invention closure.

FIGS. 4, 5 and 6 respectively show a side cut view of an outer cap 41, a cut top view of outer cap 41 and full side view of an inner cap 61 which, together, create an alternative embodiment present invention closure. As shown in FIG. 4, outer cap 41 has wall 43 and top 45. An indicia 47 is located on the side wall of the wall 43, as shown. One way ratchets 49 are located close to the bottom below keyway protrusions 51 and 53, which have different topographical characteristics. Additionally, ring 55 is included to further assist in maintaining the outer cap 41 in a non-removable but rotatable nesting or mounting on inner cap 61. Note that protrusion 51 is much wider than protrusion 53 and this type of biasing requires slots, one of which is wide enough for protrusion 53 but not protrusion 51. In other words, slots of corresponding configurations are required.

In FIG. 6, inner cap 61 includes a ring track 77 which receives ring 55 of outer cap 41 shown in FIG. 4. Inner cap 61 has side wall 63 and top 65 with indicia 67 located on top 65. Ratchets 69 of inner cap 61 will engage with ratchets 49 shown in FIG. 4. Keyway slot 71 includes a horizontal leg 73 and a partial stop 79. Indentation 75 is located above ratchets 69 and below keyway slot 71 so as to receive protrusions 51 and 53 from outer cap 41 shown in FIG. 4. These protrusions 51 and 53 will ride in a rotatable horizontal fashion about indentation 75, except when a user aligns indicia 47 and 67 and then pulls up. Protrusion 53 will ride over partial stop 79 and engage keyway slot 71 and especially leg 73 so that the outer cap 41 and inner cap 61 will be rotatable together in an opening fashion. Not shown would be threads on the inside wall of inner cap 61. (Note that stop 79 could be located higher than shown, e.g. at the top edge of leg 73.)

Figure 7:
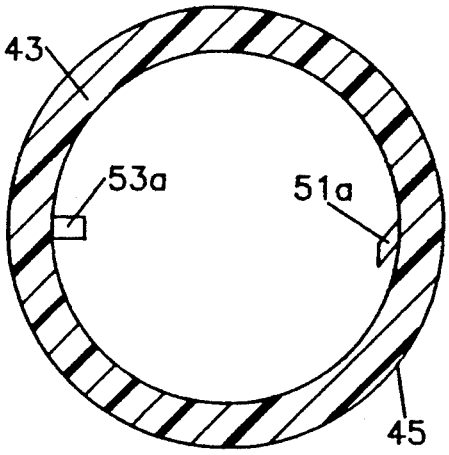
FIGS. 7 and 8 show top cut views of alternative outer caps having the general characteristics of that shown in FIG. 4.
Figure 8:
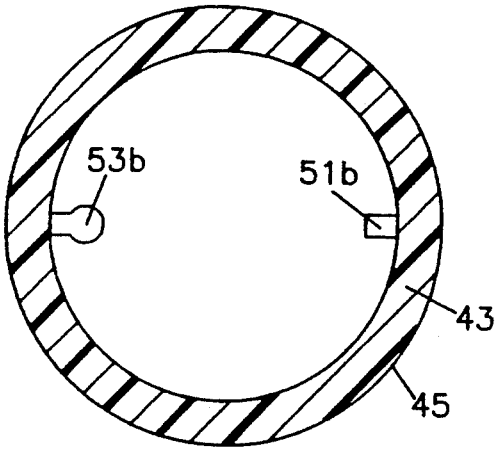

FIGS. 7 and 8 show partial cut top views of caps which are alternatives to the sets of protrusions shown in FIG. 5. In FIGS. 7 and 8 like parts to those of FIG. 5 are like numbered. In FIG. 7, protrusions 53*a* and 51*a* have different topographical configurations by having one protrusion (51*a*) angled or askance, as shown. In FIG. 8 these differences are created by protrusion 51*b* being the same as original protrusion 51 in FIG. 5, but with protrusion 53*b* being a knobbed male as shown. In both the case of FIG. 7 and of FIG. 8, the slots would correspond accordingly.

Figure 9:
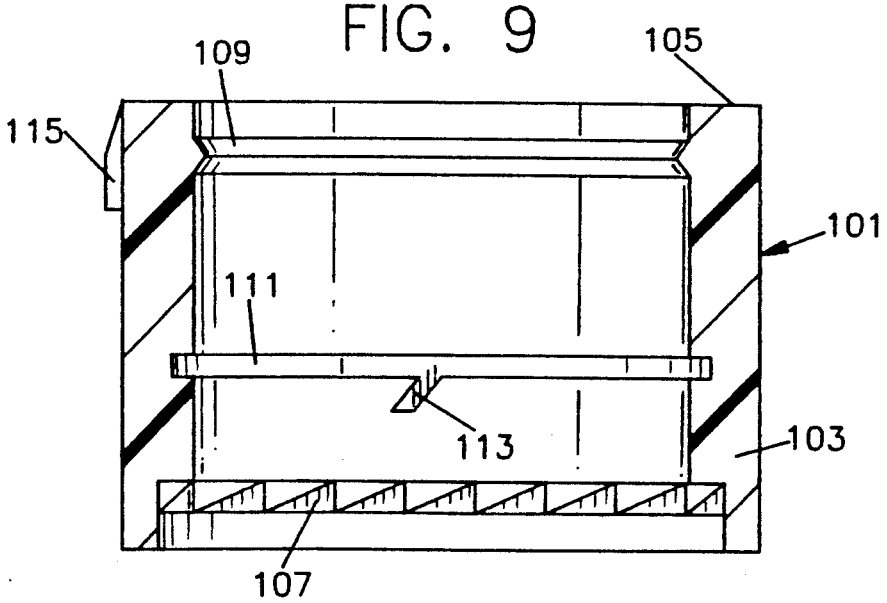
FIG. 9 shows a side cut view of an alternative embodiment outer cap of a present invention closure wherein the keyway slots are contained in the outer cap; and, FIG. 10 shows a side view of an alternative embodiment present invention closure with full view of the inner cap and a cut view of the outer cap.

FIG. 9 shows a side cut view of an alternative outer cap 101. This outer cap is similar to outer cap 41 shown in FIG. 4 except that it contains keyway slot 113 and indentation 111 in place of protrusions. Indentation 111 would be completely circular and cut into side 103 as shown. Ratchets 107 would operate effectively in the same manner as ratchets 49 shown in FIG. 4 and likewise ring 109 would engage a ring track on an inner cap. In this embodiment, the inner cap would include a protrusion and when the outer cap were properly aligned by way of indicia 115 and then lifted up a protrusion would enter track 113 and simultaneous unscrewing of this outer cap 101 and an inner cap containing the protrusion would be effected.

Figure 10:
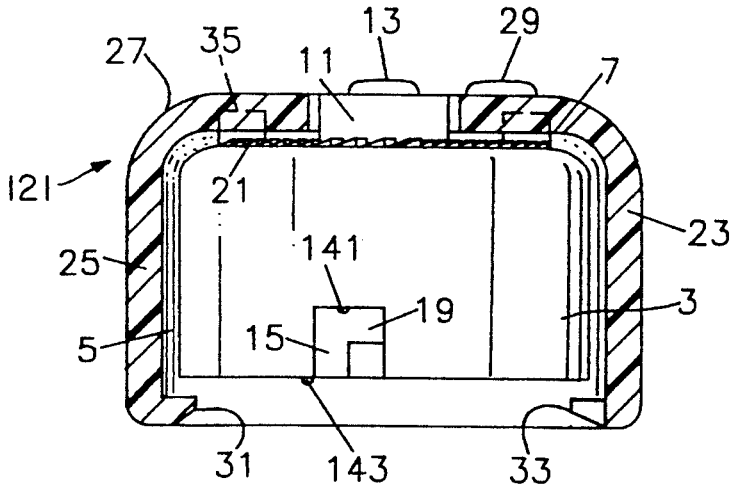

FIG. 10 illustrates an alternative present invention device 121. This is similar to device 1 in FIG. 1, in the same view and with like parts like numbered. Here, however, bump or stop 141 is located on the upper wall of top leg 19 of keyway slot 15, as shown. Additionally, stop 143 is located adjacent to the edge of keyway slot 15 as shown. This helps to prevent accidental engagement for opening by children who may be rotating the outer cap 23 with possibly some upward pull. When a protrusion "hits" stop 143, the horizontal torque needed to go under it or pass it, will cause such a protrusion to "skip" past the keyway slot 15, unless a complex movement is effected and the user knows to stop and pull up after the bump (i.e. where alignment arrows align).

Obviously, numerous modifications and variations of the present invention are possible in light of the above teachings. It is therefore understood that within the scope of the appended claims, the invention may be practiced otherwise than as specifically described herein.

What is claimed is:

1. A child resistant closure for a container having a threaded neck, which comprises:

(a) an inner cap of a generally cylindrical configuration with sides and a top having an outside and an inside and having threads on its inside adapted to as to be screwed downwardly onto and, when reversed, upwardly off a container having a threaded neck, and said inner cap being adapted to non-removably receive an outer cap rotatably engaged therewith;

(b) an outer cap of a generally cylindrical configuration with sides and a top having an inside and being non-removably mounted on said inner cap and rotatably engaged therewith:

(c) at least two biased keyway slots each being independently located on one of the outside of said inner cap and the inside of said outer cap and at least two corresponding biased keyway protrusions extending toward said keyway slots and located on the other of said outside of said inner cap and the inside of said outer cap wherein said keyway slots have top legs and at least one contains bump of sufficient elevation to require a predetermined amount of force to enable said corresponding keyway protrusion to enter said at least one keyway slot;

(d) two indicia, one on said inner cap and one on said outer cap for vertical alignment of said keyway protrusions, and said keyway slots; and, (e) ratchet ramps located on said inner cap and said outer cap, facing each other and located so as to engage each other when said outer cap is rotated in a direction to screw said inner cap downwardly and to pass over one another when said outer cap is rotated in the direction opposite to said direction which screws said inner cap downward;

said keyway protrusions being locate din a plane different form said keyway slots relative to the tops of said inner and outer caps so as to be freely rotatable in a circular manner in a horizontal plane without engaging said keyway slots and so as to engage with said keyway slots and cause simultaneous rotation of said inner cap and said outer cap when said two indicia are aligned, said outer cap is lifted upwardly to engage the protrusions with the keyway slots, and then said outer cap is rotated, thereby enabling said inner cap to be unscrewed.

2. The closure of claim 1 wherein said outer cap non-removably rests upon said inner cap, said inner cap contains said keyway slots, and said protrusions are located on the inside of said outer cap in a plane below said keyway slots relative to the tops of said inner and outer caps when at rest.

3. The closure of claim 2 wherein said inner cap also contains an indentation at a plane equal to that of said protrusions with a depth sufficient to receive said protrusions, said indentation being a continuous ring about the outside of said inner cap and being connected to said keyway slots.

4. The closure of claim 3 wherein there are at least two keyway slots which have the same topographical configuration and two corresponding keyway protrusions.

5. The closure of claim 2 wherein said outer cap has a side height greater than that of said inner cap so as to extend below said inner cap when at rest, and aid protrusions are located on the inside of said outer cap at a plane entirely below said inner cap when at rest.

6. The closure of claim 5 wherein there are at least two keyway slots which have different topographical configurations and two corresponding keyway protrusions.

7. The closure of claim 5 wherein there are at least two keyway slots which have the same topographical configurations and two corresponding keyway protrusions.

8. The closure of claim 2 wherein said outer cap has a centrally located orifice in its top and said inner cap has a centrally located circular extension of slightly less diameter than said orifice and fits into said orifice when said outer cap is non-removably mounted on said inner cap.

9. The closure of claim 1 wherein there are at least two keyway slots which have the same topographical configurations and two corresponding keyway protrusions.

10. The closure of claim 9 wherein said outer cap has a centrally located orifice in its top and said inner cap has a centrally located circular extension of slightly less diameter than said orifice and fits into said orifice when said outer cap is non-removably mounted on said inner cap.

11. The closure of claim 1 wherein said outer cap has a centrally located orifice in its top and said inner cap has a centrally located circular extension of slightly less diameter than said orifice and fits into said orifice when said outer cap is non-removably mounted on said inner cap.

* * * * *